US005392773A

United States Patent [19]

Bertrand

[11] Patent Number: 5,392,773

[45] Date of Patent: Feb. 28, 1995

[54] RESPIRATORY PARTICULATE FILTER

[76] Inventor: Archie A. Bertrand, 8319 Kittyhawk Ave., Westchester, Calif. 90045

[21] Appl. No.: 227,021

[22] Filed: Apr. 13, 1994

[51] Int. Cl.[6] ..... A62B 23/06

[52] U.S. Cl. ..... 128/206.11; 128/206.18; 128/207.13

[58] Field of Search ..... 128/201.18, 203.21, 128/207.18, 203.22, 204.11, 204.12, 206.11, 206.14, 206.18, 206.25, 207.13

[56] References Cited

U.S. PATENT DOCUMENTS

| | | | |
|---|---|---|---|
| 2,667,869 | 2/1954 | D'Elia | 128/147 |
| 3,457,917 | 7/1969 | Mercurio | 128/140 |
| 3,463,149 | 8/1969 | Albu | 128/140 |
| 3,774,601 | 11/1973 | Langone | 128/140 |
| 3,802,429 | 4/1974 | Bird | 128/146.2 |
| 4,004,584 | 1/1977 | Geaney | 128/140 |
| 4,240,420 | 12/1980 | Riaboy | 128/206.14 |
| 4,319,567 | 3/1982 | Magidson | 128/206.19 |
| 4,354,489 | 12/1982 | Riaboy | 128/206.14 |
| 4,635,628 | 1/1987 | Hubbard et al. | 128/201.17 |
| 4,856,509 | 8/1989 | Lemelson | 128/206.19 |
| 4,920,960 | 5/1990 | Hubbard et al. | 128/206.12 |
| 4,941,470 | 7/1990 | Hubbard et al. | 128/206.13 |
| 4,969,457 | 11/1990 | Hubbard et al. | 128/206.12 |
| 4,984,302 | 1/1991 | Lincoln | 2/206 |

FOREIGN PATENT DOCUMENTS

| | | | |
|---|---|---|---|
| 945897 | 12/1948 | France | 128/206.18 |
| 398989 | 7/1924 | Germany | 128/204.12 |
| 1270405 | 6/1968 | Germany | 128/207.13 |
| 5115572 | 5/1993 | Japan | 128/201.18 |

*Primary Examiner*—Edgar S. Burr
*Assistant Examiner*—William J. Deane, Jr.
*Attorney, Agent, or Firm*—Waddey & Patterson; Mark J. Patterson

[57] ABSTRACT

A respiratory particulate filter removably adheres to the lower surfaces of the user's nose with a fine mesh filtering material covering the nostrils. The adhesive section has distal, medial, and proximal adhesive tabs which secure and seal the filter while leaving the upper surfaces of the nose exposed.

6 Claims, 2 Drawing Sheets

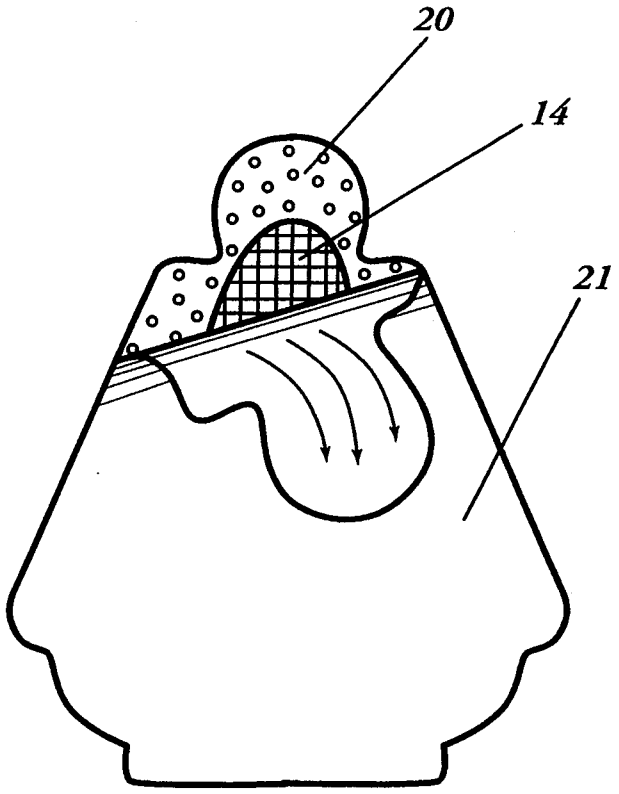
FIG. 4
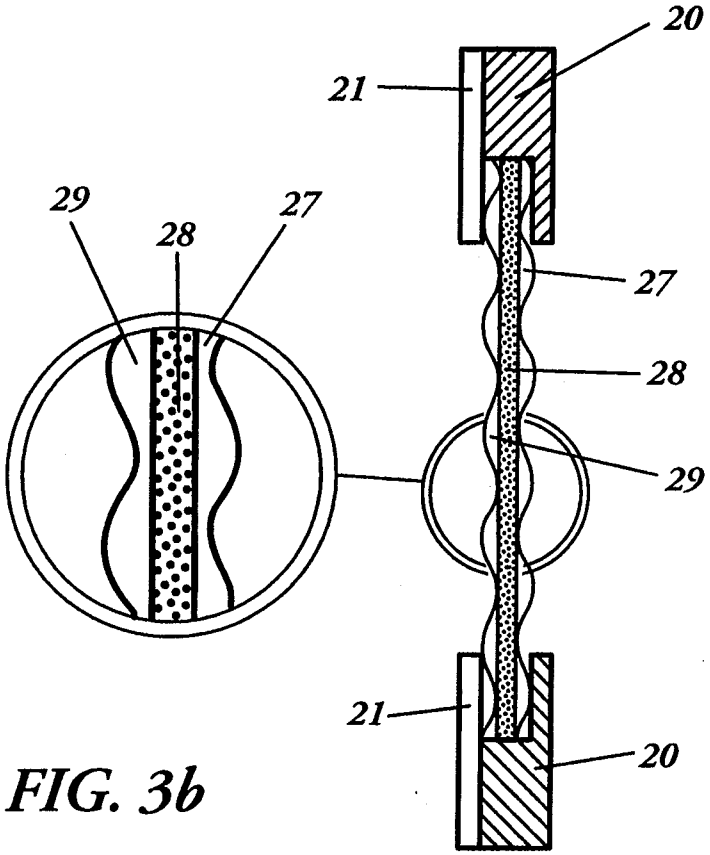
FIG. 3a
FIG. 3b

RESPIRATORY PARTICULATE FILTER

BACKGROUND OF THE INVENTION

The present invention relates generally to the respiratory filtration of dust, pollen and other airborne particulates, and more particularly to a disposable filter which removably attaches to the user's nose and filters particulates during inspiration of ambient air through the nostrils.

It will be appreciated by those skilled in the art that as more people become aware that they suffer from allergies, many are taking steps to prevent dust, pollen, and other allergens from entering the respiratory system. Some have tried wearable filters in a variety of shapes and forms. Some cover the mouth and nose, some cover the mouth, while others cover only the nostrils, the latter being very cumbersome and unsightly. It will further be appreciated by those skilled in the art that to be practical for everyday use, such filters must be easy to manufacture and inexpensive to use, and have some level of aesthetics in the design. To this end, there have been several attempts to provide a re-usable or disposable respiratory particulate filters for the nose.

U.S. Pat. No. 3,774,601 issued to Langone on Nov. 27, 1973, and U.S. Pat. No. 4,984,302 issued to Lincoln on Jan. 5, 1991, disclose the use of cotton, wool, carbon, polyethylene or polyester as a material used to filter particulate in a device attached at the nose. Unfortunately, in order to be secured, the Lincoln filter must attach high on sides of the nose which looks and feels awkward and uncomfortable. Similarly, the Langone filter covers both the mouth and the nose and is very cumbersome and unsightly.

U.S. Pat. No. 2,667,869 issued to D'Elia on Feb. 2, 1954, describes a device which wraps around the user's ears to cover the mouth. This is clearly intended not to filter particulates but to protect the user's mouth and ears. This, like Lincoln and Langone, is a very awkward device.

U.S. Pat. No. 3,802,429 issued to Bird on Apr. 9, 1974, shows a full surgical mask which must be tied to the back of user's head. This is awkward and not simple to use.

U.S. Pat. No. 4,004,584 issued to Geaney on Jan. 25, 1977, discloses a device which is placed over the user's face. Unfortunately, this too is awkward and covers too much of the face to have any aesthetic appeal.

U.S. Pat. No. 4,856,509 issued to Lemelson on Aug. 15, 1989, discloses a full mask which ties to the back of user's head. Unfortunately, this is too bulky to wear over a large period of time. The same can be said for U.S. Pat. No. 4,920,960 issued to V. Hubbard, et al issued May 1, 1990.

U.S. Pat. No. 4,354,489 issued to Riaboy on Oct. 19, 1982, discloses a filter which is placed over the mouth and a separate filter which is placed over the nose. The nose filter covers more of the nose than is necessary. The same is true with U.S. Pat. No. 4,240,420 issued to Riaboy on Dec. 23, 1980.

U.S. Pat. No. 3,463,149 issued Albu on Aug. 26, 1969, discloses an intrusive nose filter which fits within the nostrils of the user. This attachment was necessary because no one in the prior art has determined an optimum means to provide a very small filter which still attaches to the user's nose effectively.

What is needed, then, is a disposable filter which can be easily attached to the nose and effectively used to remove airborne allergens during respiration. This filter must be aesthetically pleasing and universally adhere to and accommodate virtually all nose shapes yet not cover more of the nose than is actually necessary. This device is presently lacking in the prior art.

SUMMARY OF THE INVENTION

The present invention discloses a particulate filter having a generally triangular shape, including a centrally disposed synthetic meshed filter region surrounded by an adhesive region. The adhesive region, preferably formed of porous fabric with a hypoallergenic adhesive coating on one side, includes a proximal tab, left and right medial tabs, and a distal tab which adhere to the base, lateral, and tip aspects of the nose. This leaves the upper surfaces of the nose exposed while covering the nostrils with the filter material. The proximal tab is arched along its inner margin with the filter region to better adapt it to fit at the junction point of the face with the bottom of the nose. Left and right intertabular strips, having curved inner and outer margins, join the sides of the proximal tab to the proximal ends of the medial tabs.

A paper backing covers the adhesive-coated, nose contacting surface or the filter, which is peeled off immediately prior to use.

The filter material can be coated or impregnated with a pharmaceutical compound which either inhibits allergic reactions or aids in the removal of organics in the air during inspiration.

Accordingly, one object of the present invention is to provide a respiratory particulate filter which securely attaches to the distal, medial, and proximal aspects of the nose while covering only the very lower portions of the nose.

A still further object of the present invention is to provide a filter which is effective in removing airborne allergens but does not trap or absorb moisture.

Another object of the present invention is to provide a filter which is easy to use and aesthetically pleasing.

A still further object of the present invention is to provide a disposable filter which is easily applied and removed.

BRIEF DESCRIPTION OF THE DRAWINGS

FIG. 3*a* is a side cut-away view of the filter of the present invention.

FIG. 3*b* is an enlarged cutaway side view of a section of the filter material.

FIG. 4 is a plan view of the nose filter of the present invention with the adhesive backing partially removed.

DESCRIPTION OF THE PREFERRED EMBODIMENT

Figure 2:
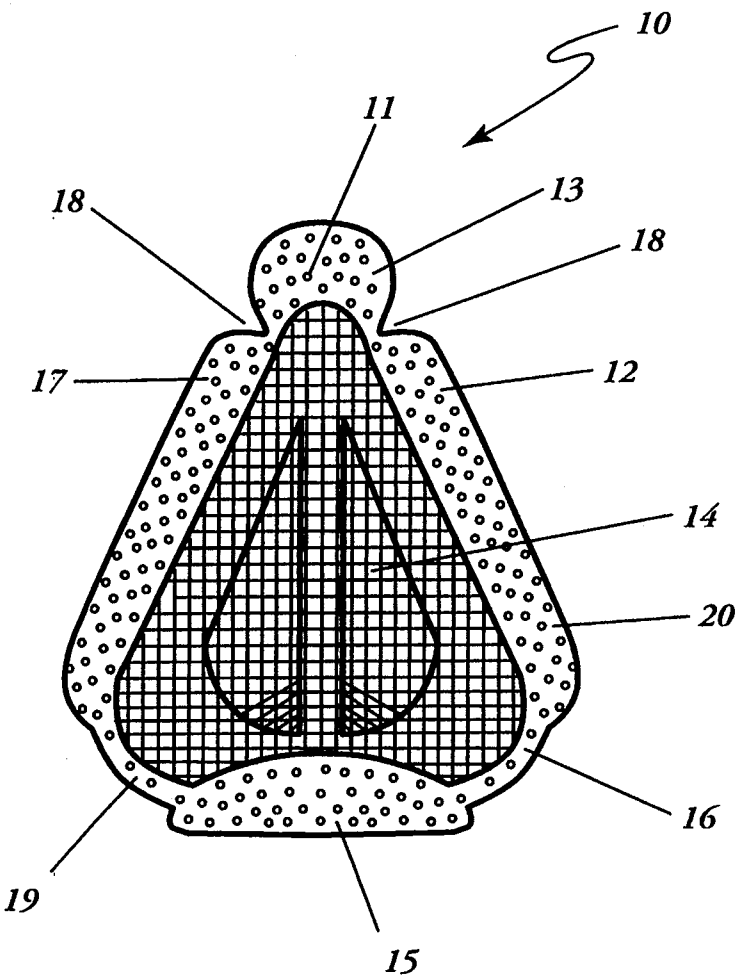
FIG. 2 is a plan view of the filter of the present invention with the adhesive backing removed.
Figure 1:
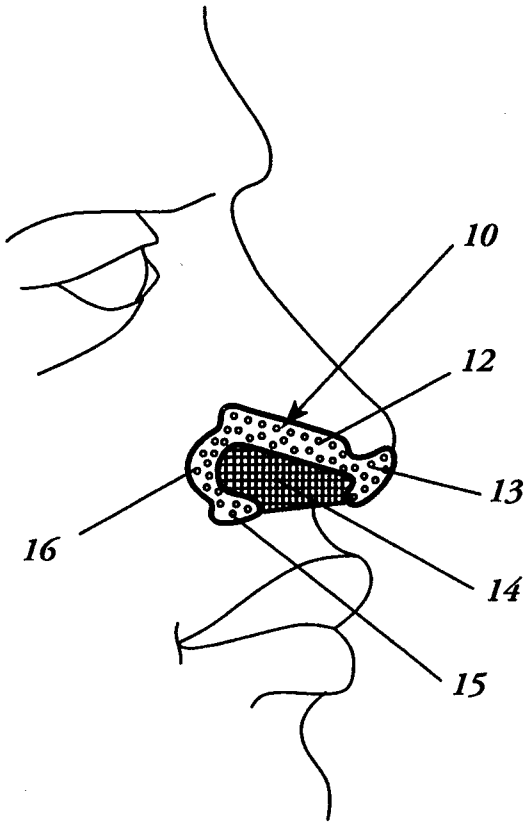
FIG. 1 is a side view of the filter of the present invention as conformed to and attached to a user's face.

Referring now to FIGS. 1 and 2, there is shown generally at 10 the particulate filter of the present invention as it is placed on user's face and nose. As best seen on FIG. 2, filter 10 has a generally triangular shape defined by an inner filter region 14 surrounded by an adhesive region 20. The novel shape and proportion of adhesive region 20 is important to the improved function and aesthetic appearance of the filter, including its ability to readily conform to noses of a variety of shapes and sizes. Accordingly, adhesive region 20 is made of a continuous piece of flexible synthetic material which includes a plurality of pores 11 which allow air to reach the skin and moisture to escape. The overall shape of adhesive region 20 is defined by a circular distal tab 13, which is joined by generally rectangular left and right medial tabs 17 and 12 to proximal tab 15. As seen on FIG. 1, distal tab 13 conforms and adheres to the lower surfaces of the tip of the nose while proximal tab 15 attaches to the skin found at the junction of the face with the bottom of the nose. Proximal tab 15 has a straight outer margin and an arched inner margin to further enhance the level of conformity.

Left and right intertabular strips 19 and 16 connect the ends of proximal tab 15 to the proximal ends of left and right me, dial tabs 17 and 12. Strips 19, 16 have outwardly curved inner and outer margins, with a width less than that of both proximal tab 15 and medial tabs 17, 12. This allows the proximal, lateral surfaces of the nose to be effectively adhered to and sealed. To similar effect, the point of interface of the distal ends of medial tabs 17, 12 with distal tab 13 is defined by inwardly tapered cutout sections 18. Accordingly, as seen on FIG. 1, filter 10 can be bent and curved along its center line and secured to the nose without covering the upper surfaces or protruding.

The selection of material for filter section 14 is also critical. A very fine mesh is needed, preferably in the range of 20–25 microns (0.0008–0.0010 inches), so that a high percentage of airborne particulate is removed. Moreover, the material must be moisture resistant. Nitex brand nylon woven screening media from Tetko, Inc. is a preferred material in this application. If desired, and as shown on FIGS. 3*a* and *b*, filter section 14 can include upper and lower fabric layers 27 and 29 surrounding a central fabric layer 28. This will allow the filter to receive a coating or impregnation of activated charcoal, antihistamine, and the like, to enhance the organic filtering and antiallergic properties of the filter.

The skin contacting surface of adhesive section 20 receives a coating of water-resistant, hypoallergenic adhesive, well known to those skilled in the art, which will removably adhere to the skin and to a removable paper backing 21, as shown on FIG. 4.

Thus, although there have been described particular embodiments of the present invention of a new and useful nose filter, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A filter for removing airborne particulate nasal respiration comprising:

a. a filter section comprising a generally triangular shaped synthetic mesh fabric;

b. an adhesive section surrounding and attached to the peripheral margin of said filter section, said adhesive section comprising a distal tab adapted for attachment to the lower surface of the tip of the nose, a proximal tab adapted for attachment to the lower surface of the base of the nose, and left and right medial tabs joining said distal and proximal tabs, said medial tabs adapted for attachment to the lateral surfaces of the nose, said proximal tab comprising a straight outer margin and an arched inner margin and said distal tab comprising a substantially circular region joined to the distal ends of said medial tabs by an interface defined by inwardly tapered cutout sections; and c. said adhesive section coated on one side with an adhesive whereby said filter can be removably attached to the skin.

2. The filter of claim 1 further comprising left and right intertabular strips joining the sides said proximal tab to the proximal ends of said left and right medial tabs, said strips having curved inner and outer margins, and said strips adapted for adhering to and sealing the proximal lateral surfaces of the nose.

3. The filter of claim 1, said adhesive section further comprising a plurality of pores communicating between the surface of the user's skin and the ambient air.

4. The filter of claim 3 wherein said synthetic mesh fabric comprises nylon having a mesh size substantially in the range of 20 to 25 microns (0.0008–0.0010 inches).

5. The filter of claim 4 further comprising a removable paper backing for covering said adhesive prior to use of said filter.

6. The filter as in any one of the proceeding claims in which said filter section further comprising inner and outer fabric layers adapted for receiving a compound for treating the air passing through said filter.

* * * * *